US006061934A

United States Patent [19]

Baggen et al.

[11] Patent Number: 6,061,934

[45] Date of Patent: May 16, 2000

[54] LOCKING SYSTEM FOR HEAT CONTROLLED IRON

[76] Inventors: Maria Josefina Herminia Baggen; Hans Jurgen Griebl, both of San Bartolome, 5, El Campello, Spain, 03560

[21] Appl. No.: 09/153,661

[22] Filed: Sep. 15, 1998

[51] Int. Cl.[7] ..... D06F 71/04

[52] U.S. Cl. ..... 38/37; 38/40; 38/1 D

[58] Field of Search ..... 38/1 C, 1 D, 1 A, 38/1 B, 63, 37; 100/53, 73, 92, 917, 43, 48, 51; 156/60, 64; 219/245

[56] References Cited

U.S. PATENT DOCUMENTS

| | | | |
|---|---|---|---|
| 2,300,541 | 11/1942 | Forse | 38/1 D |
| 2,369,243 | 2/1945 | Lechler | 38/1 C |
| 2,387,292 | 10/1945 | Preston | 38/1 D |
| 2,395,780 | 2/1946 | Devol, Jr. et al. | 38/40 |
| 5,019,193 | 5/1991 | Aramini | 156/64 |
| 5,349,767 | 9/1994 | Foo | 38/1 D X |

FOREIGN PATENT DOCUMENTS

| | | | |
|---|---|---|---|
| 1564239 | 5/1990 | Russian Federation | 38/36 |

*Primary Examiner*—Ismael Izaguirre
*Attorney, Agent, or Firm*—Robert M. Schwartz

[57] ABSTRACT

It incorporates a metallic plate (2) in the lever arm (1) which triggers the transfer plate (4) electromagnet (3), fixing the arm (1) previously positioned by the spring (10) and which presses with the iron (5) towards the transfer base (6), at the same that the countdown is started in the front (8) meter (7) of the machine, with an electromagnet (3) disconnection timer (9) and the automatic opening of the iron.

4 Claims, 2 Drawing Sheets

LOCKING SYSTEM FOR HEAT CONTROLLED IRON

OBJECT OF THE INVENTION

The invention proposed here consists of a locking system for heat controlled irons, applicable in the industrial sectors of irons, dedicated to the transfer of images from a paper to a fabric.

This invention characterizes the incorporation in the lever arm of the iron in metallic plate, which in the lowered position of the lever, contacts with a plate electromagnet, enabling it like a meter with an automatic disconnection timer, incorporating a spring and a damper in the respective movements of the lever arm of the iron, which may be one of two plates.

BACKGROUND OF THE INVENTION

Heat controlled irons for print-through are well known and sufficiently described as not to require more operational explanations.

They have the disadvantage of the irregular stress applied to the arm and from the latter to the plate, according to the operator, as well as the print-through time control of the image from the paper to the fabric.

The applicant ignores the existence of heat controlled irons like the one described in this report.

DESCRIPTION OF THE INVENTION

The invention, object of the present specification, refers to a locking system for a heat controlled iron, from between the heat controlled plates, destined to transfer prints from a transfer paper to another suitable object, for example, a fabric, a floor slab, a tile, different plastic plates, even transparent ones like methyl methacrylate, plate glass and others.

This invention is characterized by the incorporation in the lever arm of the iron of a four-sided metallic plate, which, in the lowered position contacts with the upper opposite face of an electromagnet, protruding from the front of the transfer plate base and permitting the automatic opening of the iron, once the programmed time in the timer has passed.

When the plate is deposited over the electromagnet, the latter is activated, the arm remaining strongly fastened to the plate and, simultaneously through the same circuit, a meter is activated in front of the machine, incorporating and automatic disconnection timer of the electromagnet, performing the following automatic opening.

An arm fastening spring is involved, respectively, in the movements of the lever arm of the iron, facilitating the operator's work, in the upper position and a damper arranged beneath the former, whilst the iron may be single or double.

DESCRIPTION OF THE DRAWINGS

To complement the description being made, and with the purpose of providing the best and easiest understanding of the invention characteristics, this specification is accompanied by a set of drawings with the purpose of illustrating it, without limits.

PREFERRED EMBODIMENT OF THE INVENTION

Figure 1:
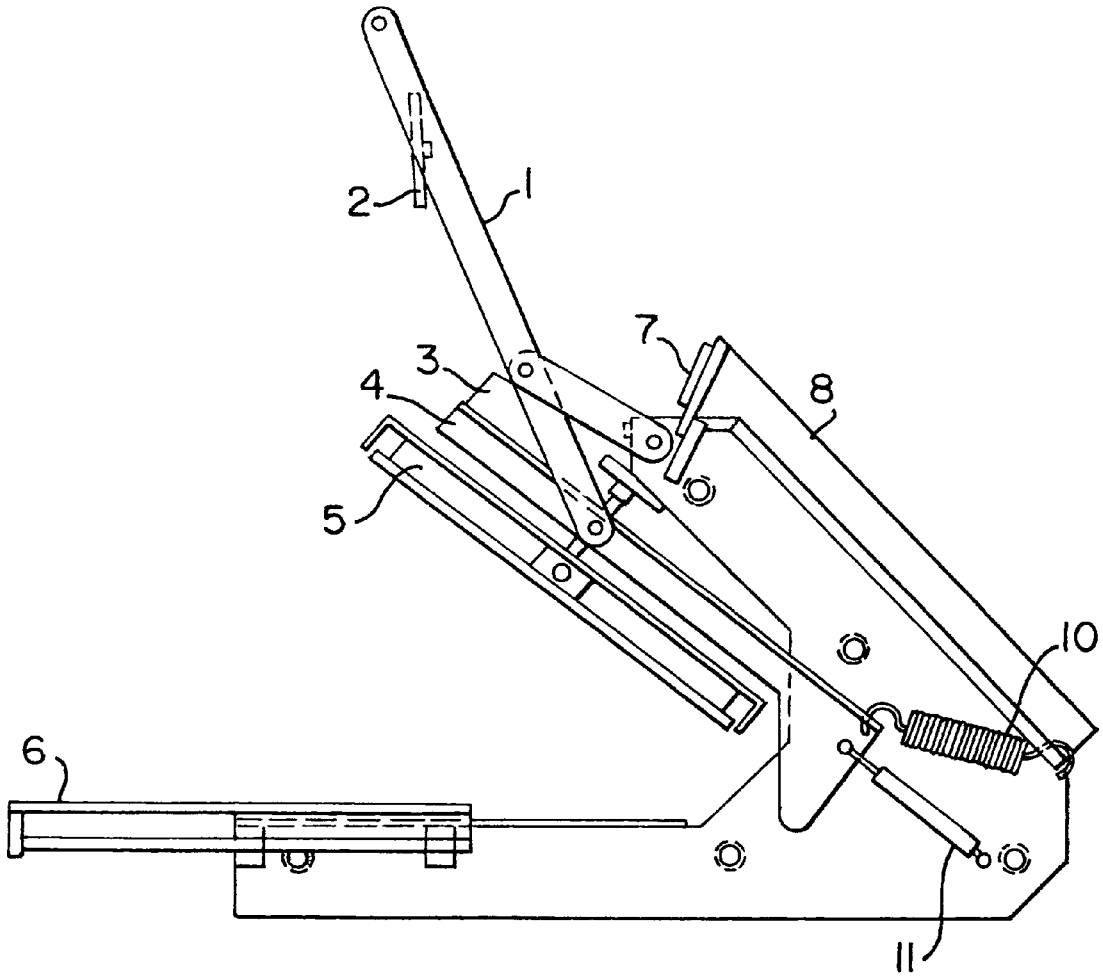
FIG. 1 shows the iron, equipped with a locking system of the invention, in its open position and ready to receive the printer paper and the object receiving the transfer.
Figure 2:
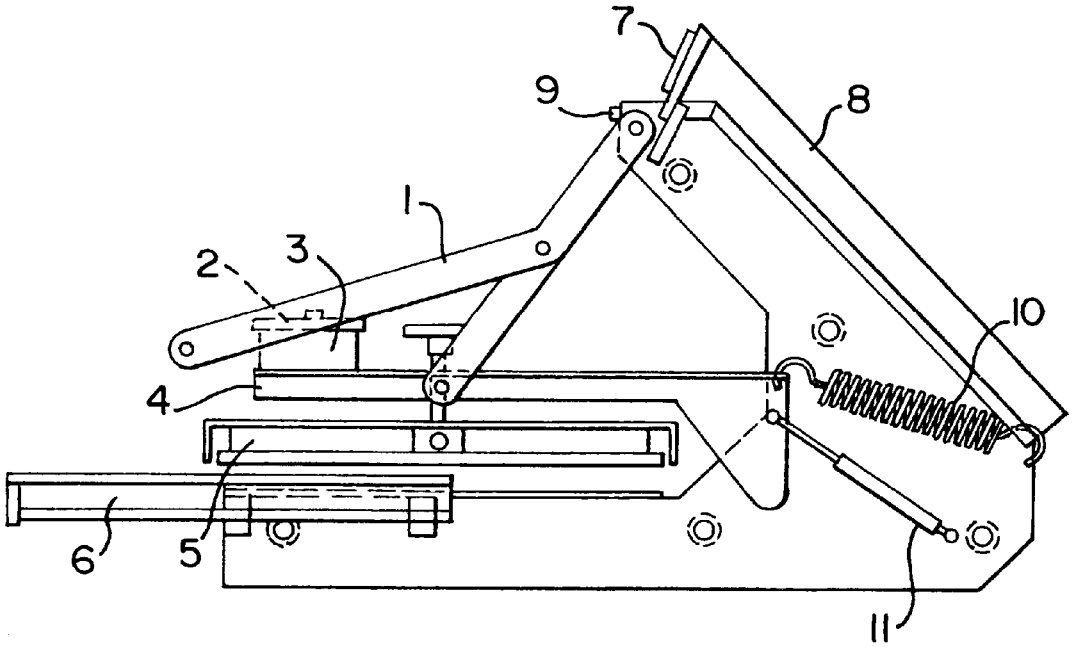
FIG. 2 shows the close position of the system of the invention.

In the light stated above, this invention refers to a locking system for a heat controlled iron, among heat controlled irons, for fabrics and other flat materials, which generally are not eroded or their surface so irregular that they do not permit this transfer, over which the paper and the product which has to receive the mentioned item are deposited, characterized by the incorporation in the lever arm (1) of a metallic plate (2), which, with the arm (1) lowered, contacts and activates the electromagnet (3) of the transfer plate (4), fastening the arm (1) with the equivalent of about 150 kg force and pressing with the iron (5) towards the transfer base (6) and, simultaneously, and by means of the same circuit, starting the countdown in the meter (7) at the machine front (8), with an automatic disconnection timer (9) of the electromagnet (3), when the meter (7) reaches zero, and performing the resulting automatic opening.

A spring (10) facilitates the arm (1) positioning, whilst an oil piston (11) acts as a damper, and the iron may be single or double, permitting in this case the preparation of a new print whilst the other is being made on the next plate.

This description is not extended further, understanding that any expert on this matter will have sufficient information to understand the scope of the invention and the advantages derived from it, as well as to proceed with its reproduction.

It is understood that, if the invention is not basically changed, both variations in materials and shape, size and arrangements of the components may be varied.

The terms and the sense included in this description should always be considered as non-limiting.

What is claimed is:

1. A locking system for a heat controlled iron, comprising:

a lever arm (1), of a metallic plate (2) which in its lowered position contacts and activates the electromagnet (3) of the transfer plate (4) to lock the arm (1) and press with the iron (5) to the transfer base (6), a front (8) meter (7) of the iron equipped with a timer (9), which automatically disconnects the electromagnet (3) and proceeds to the automatic opening of the iron when the meter (7) reaches zero, and the start of the countdown in the meter (7) at the same time the electromagnet (3) is activated.

2. A locking system for a heat controlled iron, according to claim 1, further comprising a spring (10) that facilitates the arm (1) positioning.

3. A locking system for a heat controlled iron, according to claim 1 further comprising an oil piston (11) acting as a damper.

4. A locking system for a heat controlled iron, according to claim 1 further comprising a double iron, permitting in this case, the preparation of a new print while the other is being made in the adjacent plate.

* * * * *